United States Patent [19]

Jones

[11] 4,106,654

[45] Aug. 15, 1978

[54] CONTAINER WITH SIDE SEALING CLOSURE AND METHOD OF FORMING THE SEAL THEREOF

[75] Inventor: Eugene C. Jones, Laguna Niguel, Calif.

[73] Assignee: American Hospital Supply Corporation, Evanston, Ill.

[21] Appl. No.: 776,436

[22] Filed: Mar. 10, 1977

[51] Int. Cl.[2] ..... B65D 41/04

[52] U.S. Cl. ..... 215/329; 215/341; 215/344

[58] Field of Search ..... 215/329, 341, 343, 344, 215/345, 203, 251

[56] References Cited

U.S. PATENT DOCUMENTS

| | | | |
|---|---|---|---|
| 2,952,374 | 9/1960 | Pryale | 215/329 |
| 3,224,617 | 12/1965 | Hohl | 215/341 |
| 3,592,349 | 7/1971 | Baugh | 215/329 |
| 3,815,771 | 6/1974 | Marks | 215/344 |
| 3,817,418 | 6/1974 | Mastrovito | 215/344 |
| 3,851,784 | 12/1974 | Gryncewicz | 215/344 |
| 3,901,404 | 8/1975 | Feldman | 215/344 |
| 3,923,179 | 12/1975 | Choksi | 215/203 |
| 3,923,184 | 12/1975 | Choksi | 215/251 |

FOREIGN PATENT DOCUMENTS

| | | | |
|---|---|---|---|
| 164,339 | 5/1954 | Australia | 215/343 |

*Primary Examiner*—Ro E. Hart

*Attorney, Agent, or Firm*—Tilton, Fallon, Lungmus & Chestnut

[57] ABSTRACT

An improved seal between a flexible plastic container and its closure cap, wherein the cap is provided with an internal annular shoulder engaging the tapered side surface of an annular lip provided by the neck of the container. The shoulder bears inwardly against the lip with a force sufficient to flex that lip inwardly and maintain the same in a condition of stress. Ideally, the cap is formed of a plastic of limited heat shrinkability at autoclaving temperatures; therefore, heat sterilization of the sealed container and its contents results in slight contraction of the cap and further increases the integrity of the seal. Where the container is formed of plastic material capable of softening slightly at autoclaving temperatures, the shoulder tends to penetrate the lip to a limited extent during such autoclaving to create an undercut in the lip. Later, when the contents of the container are to be used, removal of the closure produces an audible click as the shoulder is drawn from the undercut, thereby indicating that the seal has been broken.

16 Claims, 6 Drawing Figures

CONTAINER WITH SIDE SEALING CLOSURE AND METHOD OF FORMING THE SEAL THEREOF

BACKGROUND

Co-owned U.S. Pat. No. 3,923,183 discloses a plastic bottle for sterile medical liquids with a dispensing outlet sealed by a removable closure cap. The cap is threaded upon the neck of the bottle and an annular rib projecting downwardly from the undersurface of the cap engages the annular top surface of the neck to maintain a hermetic seal between the parts.

While such a seal is effective, it is difficult and relatively expensive to form in production. The closure cap is injection molded of plastic material and should any air become entrapped in the mold, especially in that portion of the mold defining the sealing rib, the resulting product may form an imperfect seal with the neck of the bottle. Since the rib is of small dimensions, even a dimensional variation that cannot be readily detected with the naked eye may render a cap commercially unsatisfactory. Should such variations go undetected during early stages of production, the result may be the expensive and wasteful rejection of bottles and their contents late in production after filling and final sterilizing.

Inadequate sealing may also be caused by other factors. Thus, the thermoplastic bottles are blow molded and, as a final step in their formation, the plastic is cut off to form the annular top surfaces of the bottle necks. Flash tends to be formed along the outer edge of that surface and, should the flash later become trapped beneath a sealing rib when the closure is threaded into place, a leak path may be formed.

SUMMARY

This invention is concerned with an improved hermetic seal construction which is highly effective and which is easier, and hence less expensive, to produce consistently on a volume-production basis. The invention is also concerned with the method of forming the seal and of enhancing or improving seal integrity during steam sterilization of the sealed container and its contents.

In brief, the improvement involves forming a side seal, rather than a top seal, between the container and its closure cap. The flexible plastic container has an upstanding neck portion which terminates in an annular lip defining a discharge opening. That lip is frusto-conical in configuration, having an upwardly and inwardly tapering side surface. The closure cap includes an internal shoulder which is sealingly engagable with the tapered surface of the lip to urge or deflect the lip inwardly when the closure is threaded downwardly into its fully tightened or lowered position. Consequently, the tapered lip is in a compressive state and exerts an outward force against the shoulder to produce a reliable and generally vertical or lateral hermetic seal between the parts. In addition, the lip forceably engages the shoulder to establish substantially uniform removal torque characteristics for the cap, such removal torque being largely independent of variations in the torque originally used to apply the cap.

The cap may be formed of any relatively rigid material but, in the best mode presently known for practicing the invention, is composed of a rigid plastic which tends to shrink to a limited extent when exposed to autoclaving temperatures. Such shrinkage occurs to a significantly greater radial extent in the cap than in the neck of the container because the cap is injection molded in a mold which is typically center-gated (producing maximum shrinkage in a radially-inward direction) unlike the container which is blow molded (producing a compression-molded neck which does not shrink appreciably more in one direction than another). Consequently, in steam sterilization (autoclaving), the high temperatures encountered (240° to 260° F.) result in a net shrinkage of the cap which produces additional interference between the parts and the formation of a superior seal.

An additional seal is also formed between the container neck and the closure cap. The neck is provided with an upwardly-facing annular bearing surface which extends outwardly at the lower end of the lip. That bearing surface is engaged by stop means in the form of an annular contact portion of the cap. Engagement between the annular contact portion and the bearing surface limits the extent of downward travel of the cap, thereby optimally controlling the amount of container lip deflection, and also produces a generally horizontal lower seal between the parts.

Annealing encountered in the sterilization cycle, and the slight softening of the plastic material of the container during such treatment, allows the annular shoulder of the closure cap to penetrate the surface of the container lip to produce an undercut in that surface. When the cap is later unscrewed to dispense the contents of the container, an audible click is normally emitted as the shoulder escapes from the undercut to indicate that a seal has been broken.

Other advantages and objects of the invention will become apparent from the specification and drawings.

DRAWINGS

DETAILED DESCRIPTION

Figure 1:
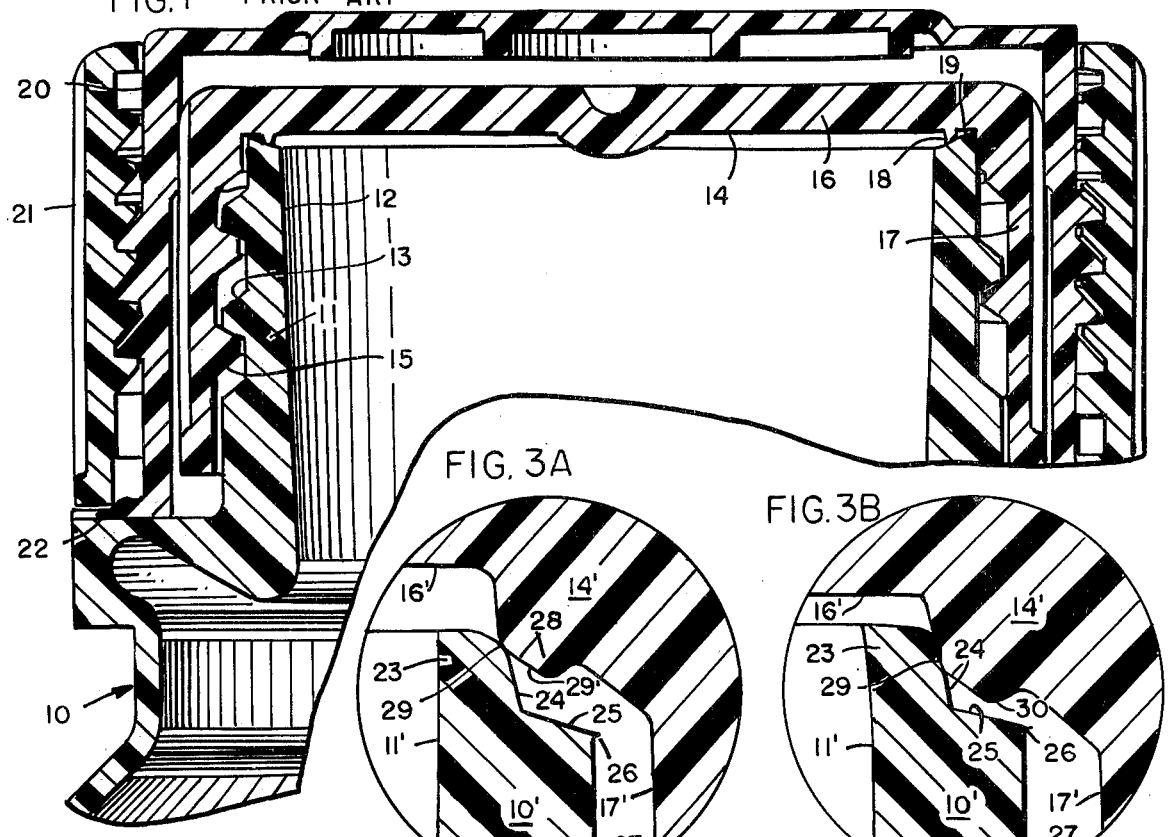
FIG. 1 PRIOR ART
FIG. 1 is a fragmentary vertical sectional view of a container closure embodying the teachings of the prior art.

Reference has already been made to co-owned U.S. Pat. No. 3,923,183 which discloses a sealing relationship between a thermoplastic container for medical liquids and a plastic cap. Such an arrangement is also depicted in FIG. 1 herein. The plastic container 10 includes a neck portion 11 which defines a discharge opening or passage 12 for the dispensing of sterile medical fluids (not shown) from the container. Such a fluid may, for example, take the form of a sterile irrigating liquid or a sterile intravenous solution, all as well known in the art. The outer surface of the neck is provided with threads 13 and a closure cap 14, having internal threads 15, is fitted upon the neck. The cap includes integral top and side walls 16 and 17, respectively, and the undersurface of the top wall is provided with an annular rib 18 which bears downwardly against the top surface 19 of the container neck to form the main seal, if not the only seal, between the parts. While such contact may form an effective hermetic seal, dimensional irregularities in the rib 18 which might be caused by air entrapment in the molding of the cap, or flash remaining at the cut surface 19 of the neck (such flash would form, if at all, at the junction of surface 19 and the outer surface of the neck) may interfere with the formation of a positive seal, particularly one which is capable of withstanding the pressures and dimensional changes which occur during autoclaving.

FIG. 1 also illustrates an outer closure 20 and a jacking ring 21 which may be rotated to force the outer closure upwardly, thereby rupturing the fusion joint 22 between the outer closure and container 10. The outer closure 20 and jacking ring 21 are disclosed in detail in patent 3,923,183 and, since those elements are not essential to a description of the present invention, further reference to them is believed unnecessary herein.

Figure 2:
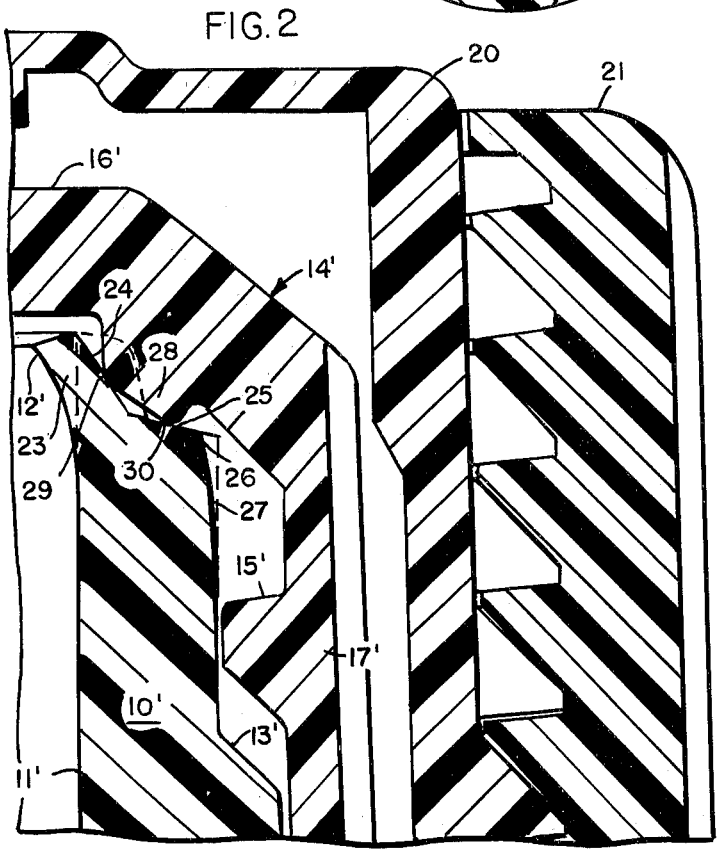
FIG. 2 is an enlarged view similar to FIG. 1 but illustrating a closure system incorporating the improvements of this invention.

The combination depicted in FIG. 2 is similar to that of FIG. 1 except for the structural relationship responsible for the formation of a hermetic seal between the parts. Plastic container 10' has a neck portion 11' defining a discharge opening 12'. Closure cap 14' has a top wall 16' and a side wall 17', the inner surface of the generally-cylindrical side wall having internal threads 15' engaging the threads 13' of the neck.

Figure 3A:
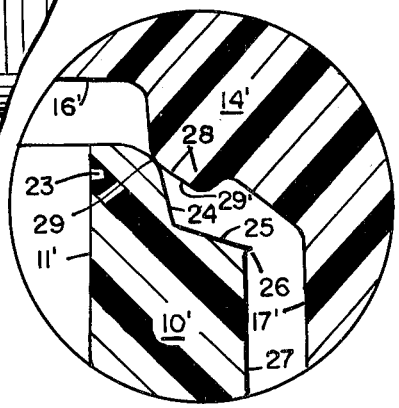
FIGS. 3A, 3B, 4 and 5 are detailed views showing a sequence of steps in carrying out the method of this invention.
Figure 3B:
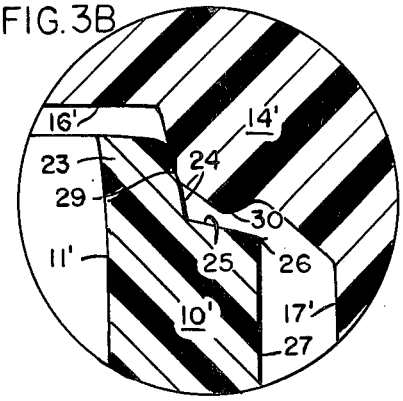

Unlike container neck 11, neck 11' terminates at its upper end in an upstanding annular lip 23 which has an upwardly and inwardly sloping side surface 24. Reference should be made to FIG. 3A and to the dashed lines in FIG. 2, for the configuration of the lip when that lip, and the neck of which it is a part, are untensioned.

An upwardly-facing annular bearing surface 25 extends outwardly from the lip at the lower end thereof, as shown most clearly in FIG. 3A. Surfaces 24 and 25 are formed during the blow-molding of the thermoplastic container and subsequently in a cutting step, a small flash 26 may be formed at the junction of bearing surface 25 and the outer surface 27 of the neck (FIG. 3A). It is to be understood that steps may be taken to avoid the formation of such flash, or to remove the flash after it has been formed; the purpose in illustrating flash 26 in the drawings is simply to show that such flash may remain without interfering in any way with the formation of an effective hermetic seal between the parts.

Closure cap 14' is formed with an internal annular bead 28 located at the merger of the inside surfaces of top wall 16' and side wall 17'. The bead has an upper edge 29 defining an internal annular shoulder engagable with the side surface 24 of lip 23. In addition, the bead has a downwardly and outwardly sloping surface 29' terminating in a lower edge 30, spaced below and laterally beyond upper edge 29, which constitutes an annular contact portion engagable with bearing surface 25. Such contact portion 30 serves as stop means for limiting the extent of downward travel of cap 14' when that cap is screwed onto neck 11'.

Figure 4:
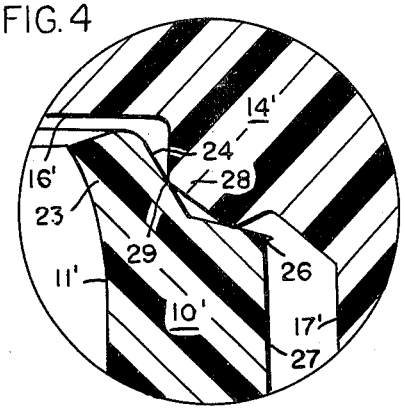

The diameter of at least a substantial portion of frusto-conical surface 24 exceeds the diameter of shoulder 29. Also, shoulder 29 is spaced below the undersurface of top wall 16' a distance substantially greater than the vertical distance between shoulder 29 and lower edge 30. As a result, as the closure is screwed downwardly upon the neck, the sloping camming surface 29' first engages the lip and then shoulder 29 bears forcibly against the sloping surface 24 to urge or flex lip 23 inwardly, as illustrated in FIGS. 3A, 3B, 4 and 2 in somewhat exaggerated form for purposes of illustration. FIGS. 2 and 4 show the parts when the cap has been screwed downwardly into its fully lowered position with contact portion 30 engaging bearing surface 25, but before heat sterilization of the container and its contents. Although flexible, the lip 23 of the plastic container is sufficiently stiff to resist such deflection or deformation. The restorative force exerted by the deformed or stressed lip intensifies the sealing action and promotes a highly effective side seal between the cap and container. As indicated, a lower or generally horizontal seal is formed between contact edge 30 and the bearing surface 25 of the neck.

In the illustration given, the cap and neck are shown with mating threads 15' and 13' for advancing the cap into its fully lowered position and for holding the closure cap in that position. It is to be understood, however, that other means, such as a bayonet-type lock or other suitable latching means, may be used for releasably holding the cap in its lowered position should a screw connection be considered objectionable for any reason.

The container may be formed from polypropylene, high density polyethylene, an ethylene-propylene copolymer, or any other suitable thermoplastic material which is tough and flexible, and which is capable of being blow molded.

If steam sterilization of the container and its contents is required, it is obvious that both the cap 14' and the container 10' must be formed of materials capable of withstanding autoclaving temperatures (i.e., 240° to 260° F.). The composition and/or construction of the cap should be such that upon heating to such temperatures the inward radial shrinkage of the cap substantially exceeds similar shrinkage of the neck. Such a result is achieved by injection molding the cap using conventional center-gating, but it is believed that other techniques may be employed, or other materials may be used, to produce similar results. The container, on the other hand, is blow molded so that its neck portion 11' is molded under compression with less radial orientation of the thermoplastic material. Radial inward shrinkage of the container neck, if it occurs at all, is therefore less than radial shrinkage of the side wall of the closure cap. Unlike prior constructions (FIG. 1), where such differences in shrinkage might tend to reduce the sealing force and even disrupt the integrity of the seal, radial shrinkage of cap 14' relative to neck 11' increases the effectiveness of the seal because it forces shoulder 29 even more tightly against the sloping side surface 24 of lip 23.

Figure 5:
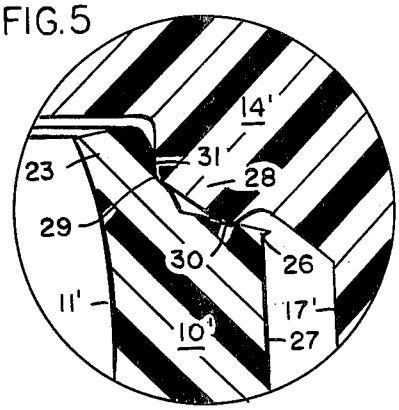

If the plastic of the container is capable of being softened slightly at autoclaving temperatures, then it has been found that the shoulder 29 tends to penetrate a limited distance into the surface 24 of the lip to form an undercut 31 as shown in FIG. 5. It has been found that under such circumstances an audible click is produced when the cap is unthreaded to break the side seal and withdraw the shoulder from the recess or undercut. It has also been found that the audible signal is not reproduced if the cap is replaced and again unscrewed from the neck; hence, the click may serve as an audible indication that the cap has not been removed previously.

While in the foregoing an embodiment of the invention has been disclosed in considerable detail for purposes of illustration, it will be understood that many of those details may be varied without departing from the spirit and scope of the invention.

I claim:

1. In combination, a flexible plastic container having an upstanding neck portion terminating in an annular lip defining a discharge opening; said lip having an upwardly and inwardly tapering side surface; a closure for said opening having a top wall, an annular side wall, and an internal shoulder sealingly engagable with said tapered surface to flex said lip inwardly when said closure is forced downwardly into a lowered position about said neck; and means for releasably holding said closure in said lowered position.

2. The combination of claim 1 in which said means for releasably holding said closure in its lowered position comprises mating threads about the outer surface of said neck and the inner surface of said side wall of said closure.

3. The combination of claim 1 in which said shoulder is annular in configuration and is engagable with said lip about the full circumference thereof.

4. The combination of claim 1 in which said closure is formed of rigid plastic material.

5. The combination of claim 4 in which said closure is injection molded and is capable of limited shrinking at autoclaving temperatures.

6. The combination of claim 1 in which said neck portion includes an upwardly-facing annular bearing surface extending outwardly from said side surface at the lower end of said lip; said closure including stop means engagable with said bearing surface for limiting the extent of downward movement of said closure about said neck.

7. The combination of claim 6 in which said stop means comprises an annular contact portion of said closure disposed below said shoulder a distance greater than the vertical distance between said shoulder and the inside surface of the closure's top wall.

8. The combination of claim 7 in which said annular contact portion sealingly engages said bearing surface of said container.

9. The combination of claim 7 in which said shoulder and said contact portion comprise the upper and lower edges of an annular internal bead located at the junction of the top and side walls of said closure.

10. The combination of claim 9 in which the lower annular edge of said bead has a diameter substantially greater than said upper annular shoulder.

11. The combination of claim 9 in which the upper edge of said bead projects inwardly into said side surface of said lip following autoclaving of said combination with said closure in its lowered position.

12. The combination of claim 9 in which said annular internal bead includes a downwardly and outwardly sloping annular surface between said upper and lower edges.

13. The combination of claim 1 in which said shoulder is annular in configuration and is engagable with said lip about the full circumference thereof; said tapering side surface being frusto-conical in configuration and having a minimum diameter smaller than the diameter of said annular shoulder and a maximum diameter greater than the diameter of said shoulder.

14. A method of hermetically sealing a flexible plastic container with a closure cap, said container being formed of flexible plastic and having an upstanding neck terminating in an annular lip defining a discharge opening, said lip having an upwardly and inwardly tapering side surface and said closure cap having an internal annular shoulder, the steps comprising forcing said closure cap downwardly about said neck to urge said annular shoulder into firm sealing engagement with said side surface of said lip and to flex said lip inwardly, and releasably securing said closure cap in its lowered position, whereby, the restoring forces exerted by said lip against said cap contribute in maintaining said container and cap in hermetically-sealed condition.

15. The method of claim 14 in which said cap is formed of relatively rigid plastic material, said cap being shrinkable radially inwardly to an extent greater than said neck when said container and cap are heated to autoclaving temperatures, wherein there is the further step of heating said container and cap at autoclaving temperatures to shrink said cap about said neck, and thereafter cooling said container and cap to room temperature.

16. The method of claim 14 in which the flexible plastic of said container assumes a softened condition when heated to autoclaving temperatures, said lip of said container being softened during said heating step until said shoulder partially penetrates said lip.

* * * * *